US010413931B1

(12) United States Patent
Drachenberg

(10) Patent No.: US 10,413,931 B1
(45) Date of Patent: Sep. 17, 2019

(54) GLUE GUN WITH SEQUENTIAL STICK FEED

(71) Applicant: ACCO Brands Corporation, Lake Zurich, IL (US)

(72) Inventor: James M. Drachenberg, Phoenix, AZ (US)

(73) Assignee: Acco Brands Corporation, Lake Zurich, IL (US)

( * ) Notice: Subject to any disclaimer, the term of this patent is extended or adjusted under 35 U.S.C. 154(b) by 0 days.

(21) Appl. No.: 16/246,061

(22) Filed: Jan. 11, 2019

(51) Int. Cl.
*B05C 17/005* (2006.01)

(52) U.S. Cl.
CPC ..... *B05C 17/0053* (2013.01); *B05C 17/0052* (2013.01)

(58) Field of Classification Search
CPC ..... B05C 17/0053; B05C 17/0052; B05C 17/00526
USPC ..... 222/325
See application file for complete search history.

(56) References Cited

U.S. PATENT DOCUMENTS 2,522,526 A * 9/1950 Manning ..... D01D 5/14 156/167
3,744,921 A 7/1973 Weller et al.
3,774,817 A * 11/1973 Whittaker ..... B05C 17/0053 222/146.5
3,973,697 A * 8/1976 Crum ..... B05B 12/002 222/47
4,289,257 A * 9/1981 Herb ..... B05C 17/0053 222/146.5
4,378,076 A * 3/1983 Stimweiss ..... B05C 17/0053 222/146.5
4,420,508 A * 12/1983 Gibson ..... B05D 7/22 118/308
4,457,457 A * 7/1984 Dziki ..... B05C 17/00543 219/230
4,664,296 A * 5/1987 Dziki ..... B05C 17/00533 219/230
4,776,490 A 10/1988 Wingert
4,998,698 A 3/1991 Martinson
(Continued)

FOREIGN PATENT DOCUMENTS

CN 202638655 U 1/2013
CN 202667089 U 1/2013
(Continued)

*Primary Examiner* — Benjamin R Shaw
(74) *Attorney, Agent, or Firm* — Michael Best & Friedrich LLP

(57) ABSTRACT

A glue gun and a method of advancing glue sticks in a glue gun. A leading glue stick is held in a channel of a feeder assembly in an active position, and a next-in-line glue stick is positioned adjacent the active position. In response to movement of a trigger of the glue gun by a user, the feeder assembly feeding the leading glue stick in an advancing direction. Upon advancement of the leading glue stick beyond a forward end of the next-in-line glue stick, the next-in-line glue stick drops freely into the active position, and a transition from feeding the leading glue stick with the feeder assembly to feeding the next-in-line glue stick with the feeder assembly occurs exclusively by repeated trigger actuation. No other steps or actions are required to put the next-in-line glue stick into the active position upon depletion of the leading glue stick.

20 Claims, 12 Drawing Sheets

(56) References Cited

U.S. PATENT DOCUMENTS

| | | | | |
|---|---|---|---|---|
| 5,105,987 | A * | 4/1992 | Quinn | B05C 17/0054 221/279 |
| 5,236,269 | A | 8/1993 | Handy | |
| 5,375,766 | A | 12/1994 | Sweeney | |
| 5,664,701 | A | 9/1997 | Massena | |
| 5,988,445 | A | 11/1999 | Massena | |
| 6,152,632 | A | 11/2000 | Shimakage et al. | |
| 6,202,892 | B1 | 3/2001 | Lasko | |
| 6,223,950 | B1 | 5/2001 | Lasko | |
| 6,558,059 | B1 | 5/2003 | Hillinger et al. | |
| 6,840,403 | B2 | 1/2005 | Girouard | |
| 7,520,408 | B1 | 4/2009 | Smith et al. | |
| 8,985,391 | B2 | 3/2015 | Ross et al. | |
| 2013/0112279 | A1 | 5/2013 | Ross et al. | |
| 2013/0112312 | A1 | 5/2013 | Ross et al. | |
| 2014/0144929 | A1 | 5/2014 | Fitzmeyer et al. | |
| 2015/0083752 | A1 | 3/2015 | Shin | |
| 2015/0141538 | A1 | 5/2015 | Melendy et al. | |
| 2016/0151802 | A1 | 6/2016 | Faber et al. | |
| 2017/0259295 | A1 | 9/2017 | Seferi | |
| 2017/0341103 | A1 | 11/2017 | Cash et al. | |

FOREIGN PATENT DOCUMENTS

| | | | |
|---|---|---|---|
| CN | 103447202 | A | 12/2013 |
| CN | 206356216 | U | 7/2017 |
| CN | 105537072 | B | 10/2017 |
| CN | 206911608 | U | 1/2018 |
| CN | 107694862 | A | 2/2018 |
| DE | 202004016067 | U1 | 1/2005 |
| DE | 102011001619 | A1 | 10/2012 |
| DE | 102016104981 | A1 | 9/2017 |
| DE | 102016210607 | A1 | 12/2017 |
| DE | 102016008847 | A1 | 1/2018 |
| DE | 102016217095 | A1 | 3/2018 |
| GB | 2483950 | A | 3/2012 |
| KR | 200446273 | Y1 | 10/2009 |
| KR | 101332322 | B1 | 12/2013 |
| KR | 101361014 | B1 | 2/2014 |
| WO | WO 1999/018027 | A1 | 4/1999 |

* cited by examiner

GLUE GUN WITH SEQUENTIAL STICK FEED

BACKGROUND

The present invention relates to hand-held cordless or corded adhesive dispensers, commonly known as glue guns, that are electrically powered to melt the adhesive from stick form for controlled discharge.

SUMMARY

In one aspect, the invention provides a glue gun including a housing, an outlet nozzle, and a multi-stick cartridge. The housing includes a handle and a barrel, the handle having an upper end mated with the barrel. The outlet nozzle is positioned at a forward end of the housing for dispensing glue. The multi-stick cartridge is configured to hold a plurality of stacked glue sticks, including a leading glue stick held in a channel defining an active position and movable in an advancing direction toward the outlet nozzle, and also a next-in-line glue stick positioned adjacent the active position. A heating element is operable to melt the glue of the leading glue stick prior to being dispensed from the outlet nozzle. A trigger is movably coupled to the housing and operable for advancing the leading glue stick in the advancing direction. A feeder assembly is coupled to the trigger and movable in response to movement of the trigger. The feeder assembly is operable to feed the leading glue stick in the advancing direction so that, upon advancement of the leading glue stick beyond a forward end of the next-in-line glue stick, the next-in-line glue stick drops freely into the active position within the feeder assembly. Thus, transition from feeding the leading glue stick with the feeder assembly to feeding the next-in-line glue stick with the feeder assembly is enabled exclusively by repeated trigger actuation.

In another aspect, the invention provides a glue gun including a housing, an outlet nozzle, and a multi-stick cartridge. The housing includes a handle and a barrel, the handle having an upper end mated with the barrel. The outlet nozzle is positioned at a forward end of the housing for dispensing glue. The multi-stick cartridge is configured to hold a plurality of stacked glue sticks, including a leading glue stick held in a channel defining an active position and movable in an advancing direction toward the outlet nozzle, and also a next-in-line glue stick positioned adjacent the active position. A heating element is operable to melt the glue of the leading glue stick prior to being dispensed from the outlet nozzle. A trigger is movably coupled to the housing and operable for advancing the leading glue stick in the advancing direction. A feeder assembly is coupled to the trigger and movable in response to movement of the trigger. The feeder assembly includes a feeder base, a feeder tray, and at least one pincer. The feeder tray is reciprocable within the housing and has an open top defining an unobstructed path for the next-in-line glue stick to drop freely into the active position. The feeder base is reciprocable within the housing and selectively slidable with respect to the feeder tray. The at least one pincer is coupled to the feeder base and the feeder tray in such a way that the at least one pincer deploys from a recessed position to a deployed position upon actuation of the feeder assembly by the trigger. The at least one pincer extends into the channel in the deployed position.

In yet another aspect, the invention provides a method of advancing glue sticks in a glue gun. A plurality of stacked glue sticks are provided, including a leading glue stick held in a channel of a feeder assembly in an active position to be moved by the feeder assembly in an advancing direction toward an outlet of the glue gun, and also a next-in-line glue stick positioned adjacent the active position. In response to movement of a trigger of the glue gun by a user, the feeder assembly feeds the leading glue stick in the advancing direction. Upon advancement of the leading glue stick beyond a forward end of the next-in-line glue stick, the next-in-line glue stick drops freely into the active position within the feeder assembly, and a transition from feeding the leading glue stick with the feeder assembly to feeding the next-in-line glue stick with the feeder assembly occurs exclusively by repeated trigger actuation. No other steps or actions are required to put the next-in-line glue stick into the active position upon depletion of the leading glue stick.

Other aspects of the invention will become apparent by consideration of the detailed description and accompanying drawings.

DETAILED DESCRIPTION

Before any aspects of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
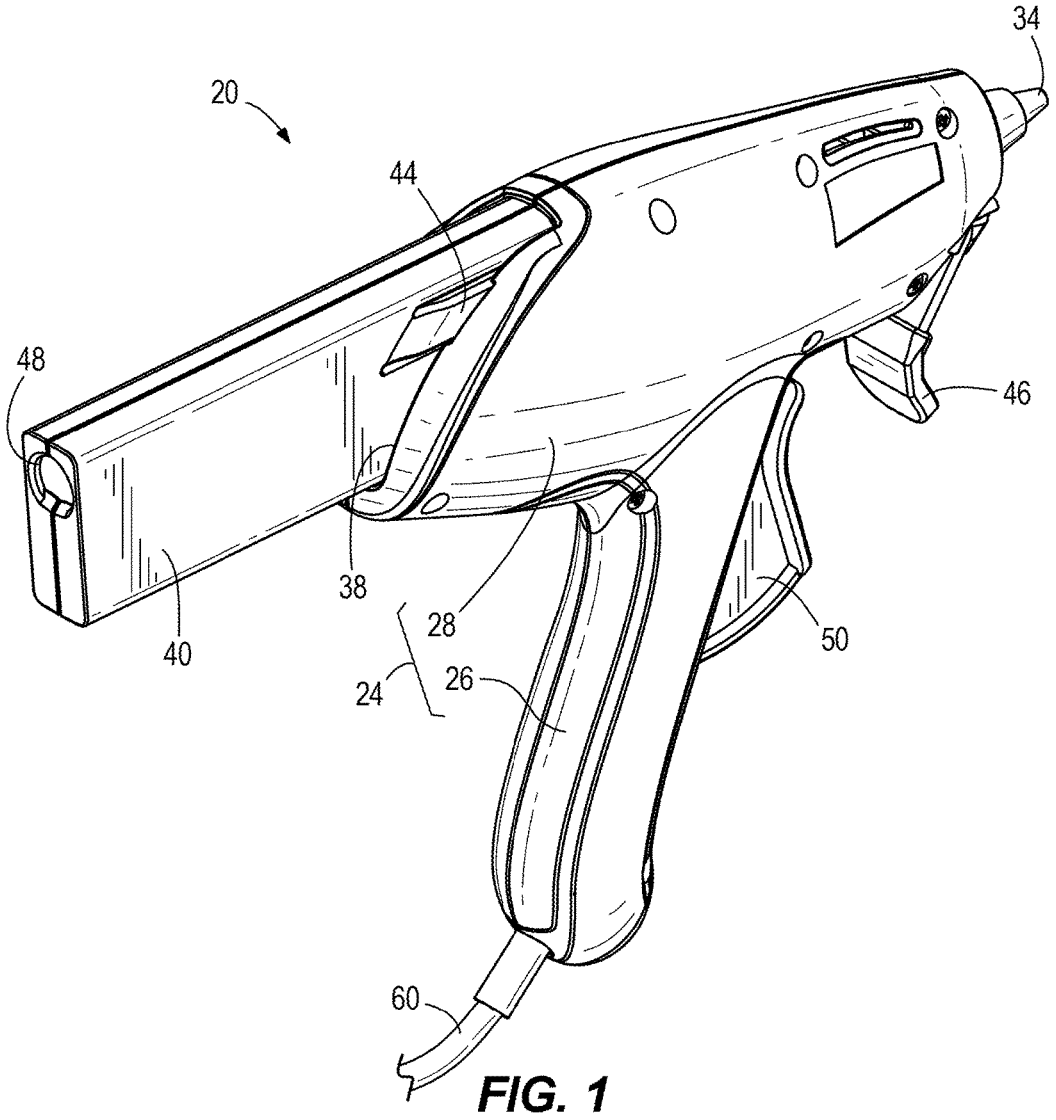
FIG. 1 is a perspective view of a glue gun according to one embodiment.
Figure 2:
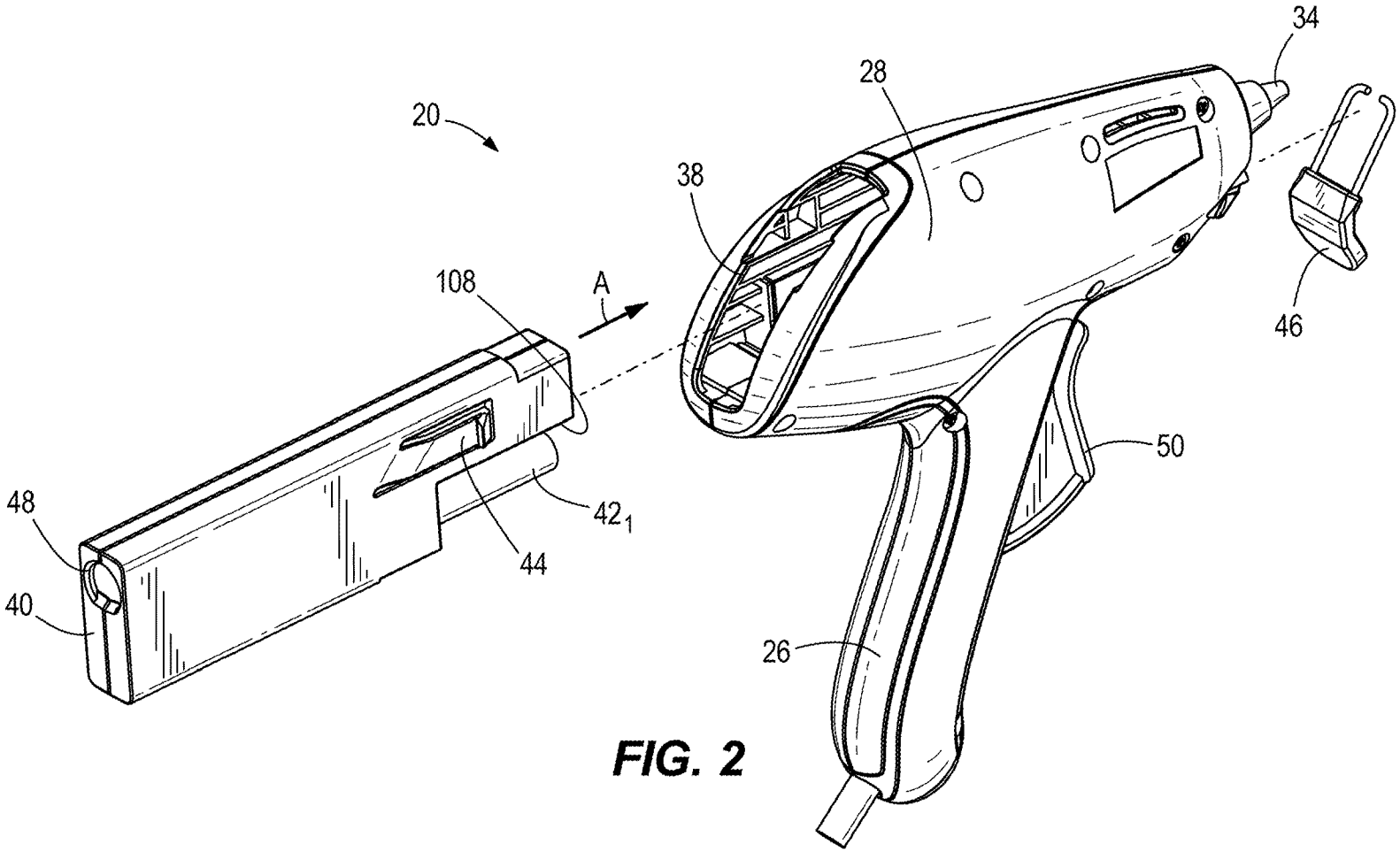
FIG. 2 is a perspective view of the glue gun of FIG. 1, a multi-stick cartridge of the glue gun being removed from a rear housing opening.
Figure 3:
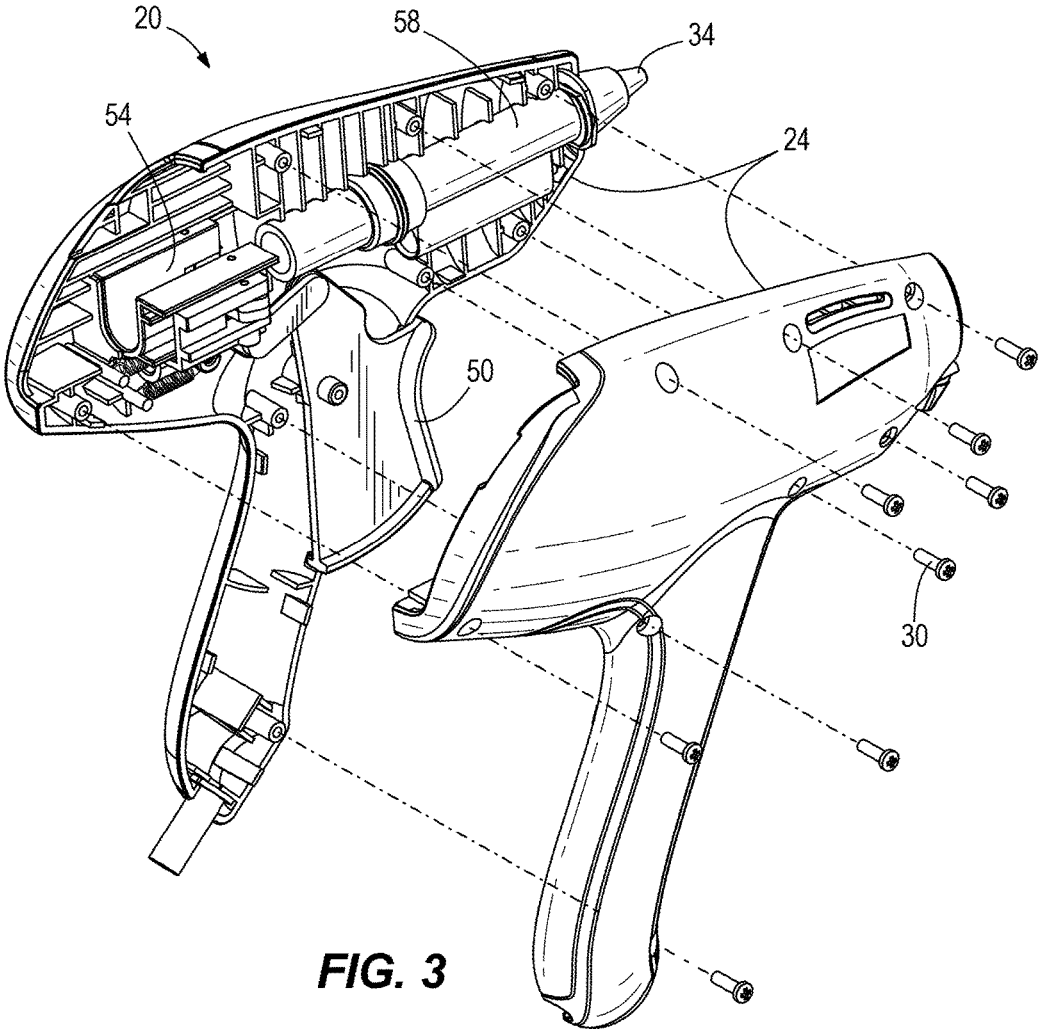
FIG. 3 is a partially exploded perspective view illustrating two portions of the glue gun housing separated in a lateral direction.

FIG. 1 illustrates a glue gun 20 according to one embodiment of the present disclosure. The glue gun 20 includes a housing 24 having both a handle 26 and a barrel 28. The barrel 28 is positioned generally atop the handle 26 such that an upper end of the handle is mated with the barrel 28. The handle 26 and the barrel 28 form separate distinguishable portions of the housing 24 and may be manufactured either separately or integrally. In the illustrated construction as shown in FIG. 3, the housing 24 is provided by two separate lateral portions, each of which forms both a part of the handle 26 and a part of the barrel 28 (e.g., a left half and right half, respectively). The two housing portions can be joined with a plurality of (e.g., threaded) fasteners 30 as illustrated, or may be secured by other optional means, such as integral snap latches, adhesive, etc. An outlet nozzle 34 is provided at a forward end of the housing 24 for dispensing liquid glue from the glue gun 20. At a rear of the housing 24, an opening 38 is provided for receiving a multi-stick cartridge 40 that includes multiple levels for holding at least two solid glue sticks, one of which is the active glue stick and one or more of which is held as a reserve glue stick(s). With the glue gun 20 held in an upright orientation as shown in FIG. 1, the illustrated cartridge 40 holds glue sticks in a vertically-stacked orientation. The opening 38 can be skewed with respect to both a direction of extension of the handle 26 and a direction of extension of the barrel 28. As such, the opening 38 can be nearer the tip end or outlet nozzle 34 at the top of the opening 38 as compared to the bottom of the opening 38. The cartridge 40 is removable, for example to be reloaded, as shown in FIG. 2. A releasable latch 44 selectively secures the cartridge 40 to the housing 24. The cartridge 40 further includes an aperture 48 at a rear end thereof. Through the aperture 48, the user may load an additional glue stick(s) while the cartridge 40 remains engaged with the glue gun 20. The aperture 48 may also serve to allow at least partial observation of the contents of the cartridge 40. However, the cartridge 40 is manufactured of transparent or translucent material in some constructions such that the contents of the cartridge 40 are externally visible through the cartridge 40. The housing 24 also supports a stand 46 adjacent the outlet nozzle 34, the stand 46 being adapted for selective deployment to an operative position that will support the housing 24 to keep the outlet nozzle 34 above a support surface at times when the user needs to set the glue gun 20 down.

A trigger 50 is movably coupled to the housing 24 and operable for advancing the active glue stick in an advancing direction A (see FIGS. 5-9) toward the outlet nozzle 34. As will be appreciated from the further description following, the trigger 50 is operable to advance a glue stick $\mathbf{42}_1$ that is in a leading position of the cartridge 40 (e.g., a bottom-most position in the case of the illustrated cartridge 40). This is referred to henceforth as the leading glue stick $\mathbf{42}_1$, while a next glue stick above the leading glue stick $\mathbf{42}_1$ is referred to as the next-in-line glue stick $\mathbf{42}_2$. Operation of the trigger 50 does not directly advance the next-in-line glue stick $\mathbf{42}_2$. As shown in FIG. 3, the trigger 50 is coupled to a feeder assembly 54, at least a portion of which physically engages the leading glue stick $\mathbf{42}_1$ to feed it forward in the advancing direction A. The feeder assembly 54, in response to trigger depression, feeds the leading glue stick $\mathbf{42}_1$ toward or through a heated assembly, which is referred to as a hot end 58, having therein an electrically-powered heating element operable to melt the glue prior to being dispensed from the outlet nozzle 34. Electric power is supplied to the hot end 58 through a power cord 60, a portion of which is shown at the bottom of the handle 26 in FIG. 1. Within the cartridge 40, the next-in-line glue stick $\mathbf{42}_2$ lies directly on the leading glue stick $\mathbf{42}_1$ when the leading glue stick $\mathbf{42}_1$ is in the active position.

Figure 4:
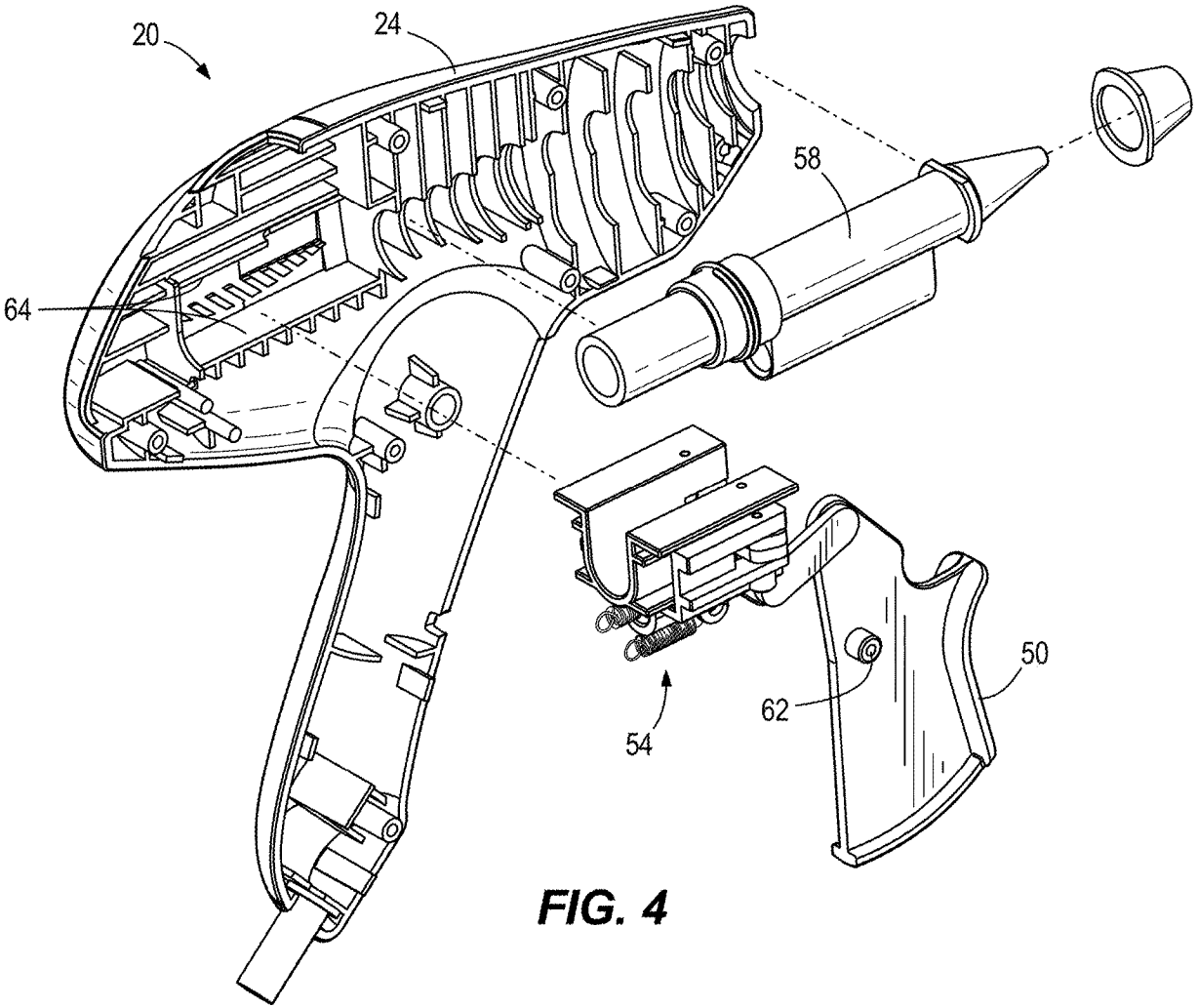
FIG. 4 is a perspective view of a trigger, a hot end, and a feeder assembly exploded from a portion of the housing of the glue gun.
Figure 5:
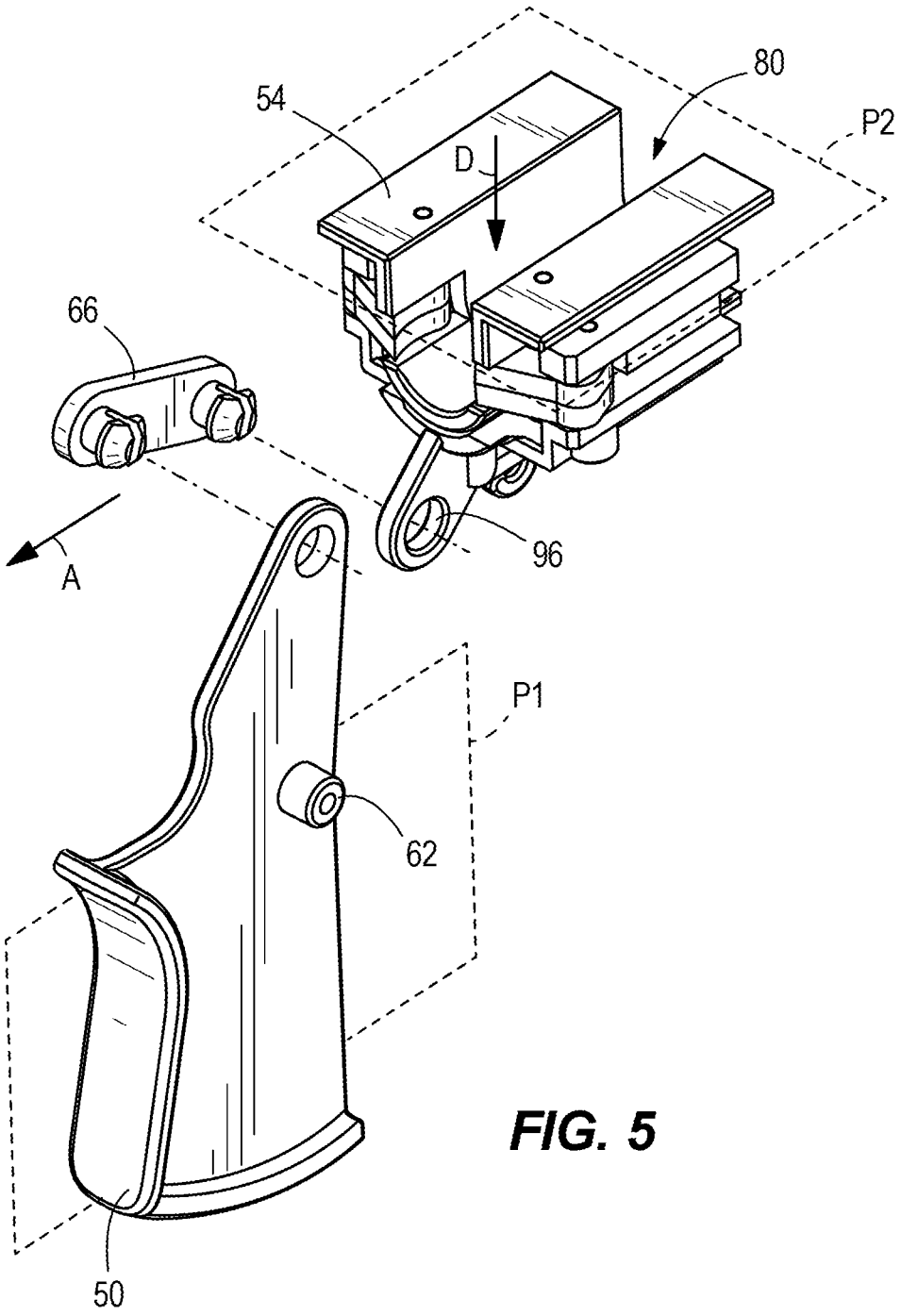
FIG. 5 is an exploded assembly view of the trigger, the feeder assembly, and an intermediate coupling link therebetween.
Figure 6:
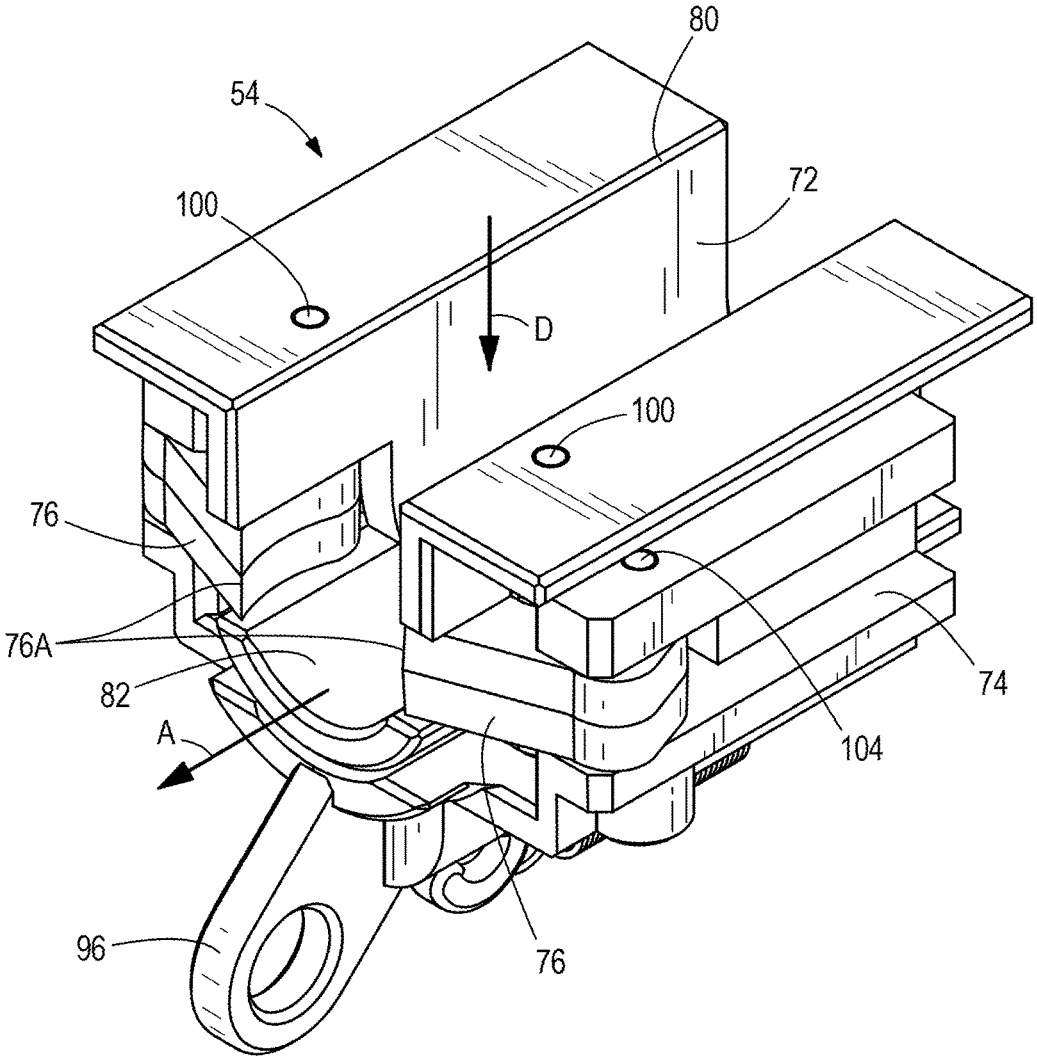
FIG. 6 is a perspective view of the feeder assembly.

As noted above, FIG. 3 illustrates the housing 24 separated to reveal the feeder assembly 54. FIG. 4 further illustrates the trigger 50 and the feeder assembly 54 removed from the housing 24 (along with the hot end 58). As can be appreciated from FIGS. 3 and 4, the trigger 50 and the feeder assembly 54 are both movably supported by the housing 24, independently of each other. The trigger 50, for example, can be pivotably supported with respect to the housing 24 with a pivot 62. Alternately, the trigger 50 can be supported to translate or provide a combined rotation and translation. The trigger 50 moves back and forth within a plane P1 shown in FIG. 5. The feeder assembly 54 is slidably supported by the housing 24 in the illustrated construction, for example, by a plurality of flat guide surfaces 64 (FIG. 4) that define a housing channel in which the feeder assembly 54 reciprocates during use as the trigger 50 is operated and released. Although only one side of the housing 24 is shown in FIG. 4, it will be appreciated that the opposing side of the housing 24 can have similar or identical guide surfaces 64. Alternatively or in addition, the cartridge 40 can provide one or more guide surfaces for guiding the feeder assembly 54. As described in more detail below, the feeder assembly 54 is guided to perform a reciprocating forward-and-back sliding stroke upon each pull-and-release motion of the trigger 50. As best shown in FIG. 5, a coupling link 66 establishes an operative driving connection for actuating the feeder assembly 54 in response to movement of the trigger 50. The coupling link 66 can be pivotably coupled to the trigger 50 and the feeder assembly 54, respectively, at its opposing ends (e.g., with a pin joint).

The feeder assembly 54 is spring-biased with respect to the housing 24, as described in further detail below, to indirectly bias the trigger 50 to an outward or non-depressed position. The feeder assembly 54 includes several main components, including first and second feeder bodies 72, 74 and at least one pincer 76 (e.g., a pair of opposed pincers 76) supported by at least one of the feeder bodies 72, 74. The first and second feeder bodies 72, 74 are movable relative to each other, and both are movable (e.g., together as a unit) relative to the housing 24. The first feeder body 72 forms a tray for receiving the leading glue stick $\mathbf{42}_1$ and is referred to henceforth as the feeder tray 72. The second feeder body 74 is referred to henceforth as the feeder base 74. The feeder tray 72 defines an opening 80 or open side of the feeder assembly 54 that is open to freely receive the next-in-line glue stick $\mathbf{42}_2$ once the leading glue stick $\mathbf{42}_1$ has sufficiently passed in the advancing direction A (i.e., there is an unobstructed path for the next-in-line glue stick $\mathbf{42}_2$ to reach the level of the pincers 76 once the leading glue stick $\mathbf{42}_1$ advances). Opposite the opening 80, the feeder tray 72 defines a base 82 against which the actively-fed glue stick, initially the leading glue stick $\mathbf{42}_1$, lies. As illustrated, the base 82 can be a bottom surface, with reference to the upright orientation and the direction established by the overall glue gun 20 (the barrel 28 forming a top, and the handle 26 extending below the barrel 28). Assuming the glue gun 20 is held in an upright orientation as shown in FIG. 1, or at least a predominantly upright orientation, this allows the next-in-line glue stick $\mathbf{42}_2$ to fall to the base 82, in a direction D (FIG. 6), by gravity alone. The direction D is perpendicular to the advancing direction A. The direction D is also perpendicular to a plane P2 (FIGS. 5 and 9) in which the pincers 76 deploy and retract. The pincer plane P2 is perpendicular to the trigger plane P1 as shown in FIG. 5. The pincer plane P2 is a horizontal plane in the illustrated construction, when the glue gun 20 is held in an upright orientation as shown in FIG. 1. These features are particularly advantageous for providing automatic glue stick renewal when used with a vertically-stacked cartridge 40 as shown. However, the feeder assembly 54 may be used in other orientations within the glue gun 20 in other constructions, for example, if it is desired for subsequent glue sticks to load into the active position in a bottom-up direction, or from a lateral side. Such a construction can be achieved by requiring a different orientation of use, a designated reloading motion, or a spring-bias of the glue sticks within the cartridge 40. Each of the feeder tray 72 and the feeder base 74 is separately coupled to the housing 24 with a respective spring 86, 88. The springs 86, 88 provide elastic biasing of the feeder tray 72 and the feeder base 74. The springs 86, 88 can be coil springs as shown or other types of springs, for example, elastic bands or the like. The springs 86, 88 can also be dissimilar from each other in construction and/or spring constant. For example, the spring 86 for the feeder tray 72 can have a higher spring constant than that of the spring 88 for the feeder base 74. In some constructions, the spring constant of the feeder tray spring 86 exceeds that of the feeder base spring 88 by a factor of at least 1.5, at least 2.0, or at least 2.5. In one non-limiting example, the spring constant of the feeder tray spring 86 is 0.285 N/mm (1.63 lbf/in)+/−20 percent, while the spring constant of the feeder base spring 88 is 0.109 N/mm (0.62 lbf/in)+/−20 percent. The feeder tray 72 and feeder base 74 include respective spring hooks 90, 92 for connection with the springs 86, 88. As illustrated, the feeder tray spring 86 and the feeder base spring 88 extend parallel to each other and parallel to the advancing direction A.

The feeder base 74 has, for example at a forward end thereof, a trigger connection portion 96. As illustrated, the trigger connection portion 96 is indirectly connected to the trigger 50 through the coupling link 66, but the trigger connection portion 96 can be directly coupled to the trigger 50 in other constructions. The feeder base 74 is the only part of the feeder assembly 54 that is directly actuated by the trigger 50, whereas the other portions of the feeder assembly 54 are actuated indirectly by the trigger 50, through the feeder base 74. Both of the feeder tray 72 and the feeder base 74 are actuated by the trigger 50 against the bias of the springs 86, 88, which normally bias the feeder assembly 54 to an at-rest or home position, which is the most rearward position within the housing 24. Although the feeder base 74 is slidable parallel to the advancing direction A with respect to the feeder tray 72, the feeder tray 72 is effectively driven in the advancing direction A by the feeder base 74. In particular, the feeder tray 72 and the feeder base 74 are coupled together through the pincers 76. As illustrated, each pincer 76 defines pin joints with each of the feeder tray 72 and the feeder base 74. The pin joints with the feeder tray 72 are positioned laterally inboard of the pin joints with the feeder base 74 and have a narrower spacing distance therebetween. The pin joints between the pincers 76 and the feeder tray 72 are provided by a first set of pins 100 engaged with respective holes 102A, 102B of the feeder tray 72 and the pincers 76. The pin joints between the pincers 76 and the feeder base 74 are provided by a second set of pins 104 engaged with respective holes 106A, 106B of the feeder base 74 and the pincers 76. The holes 106B are elongated rather than circular and form slotted pin joints that allow a distinct range of relative motion or "lost motion" therebetween.

Figure 7:
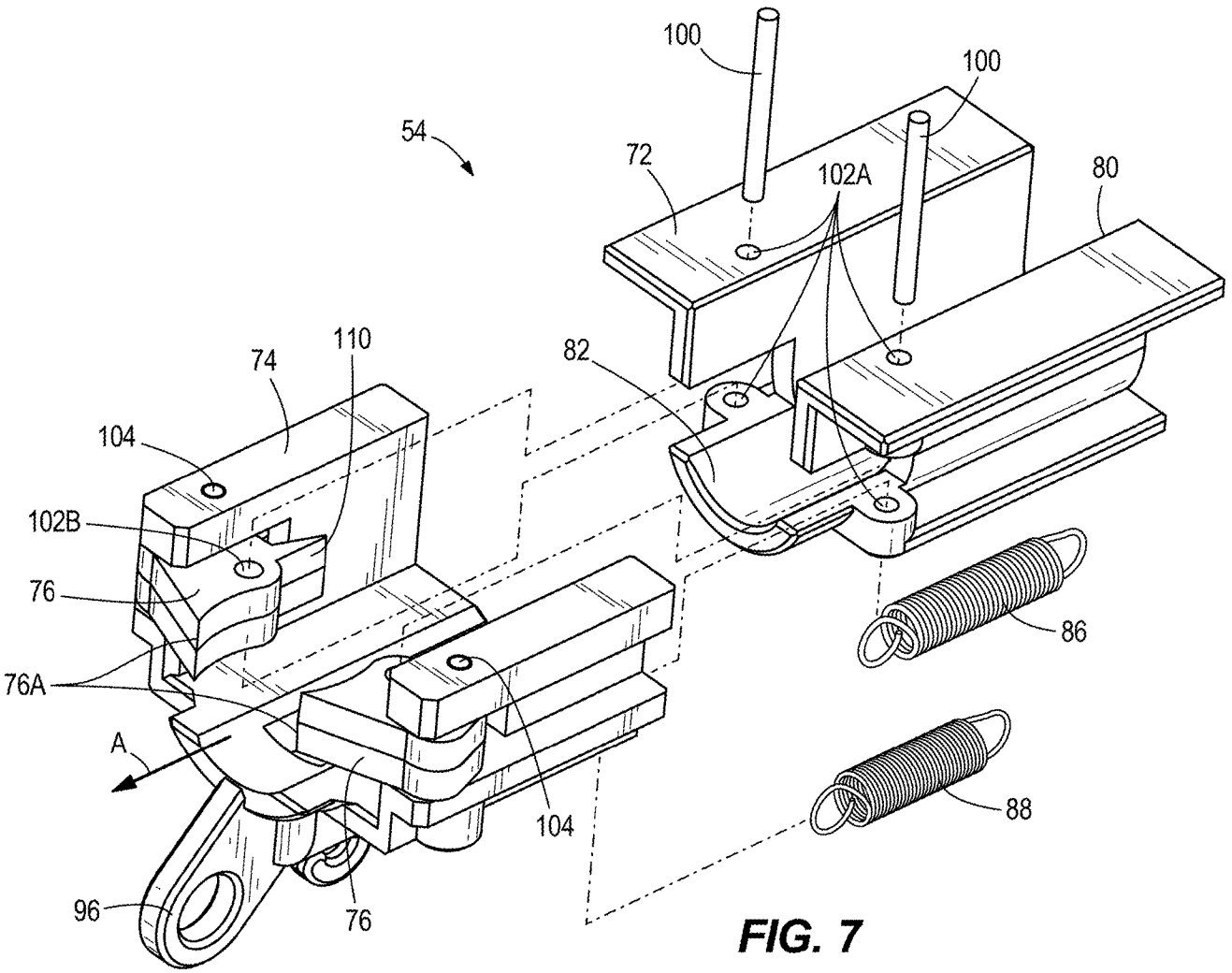
FIG. 7 is a partially exploded assembly view of the feeder assembly.
Figure 8:
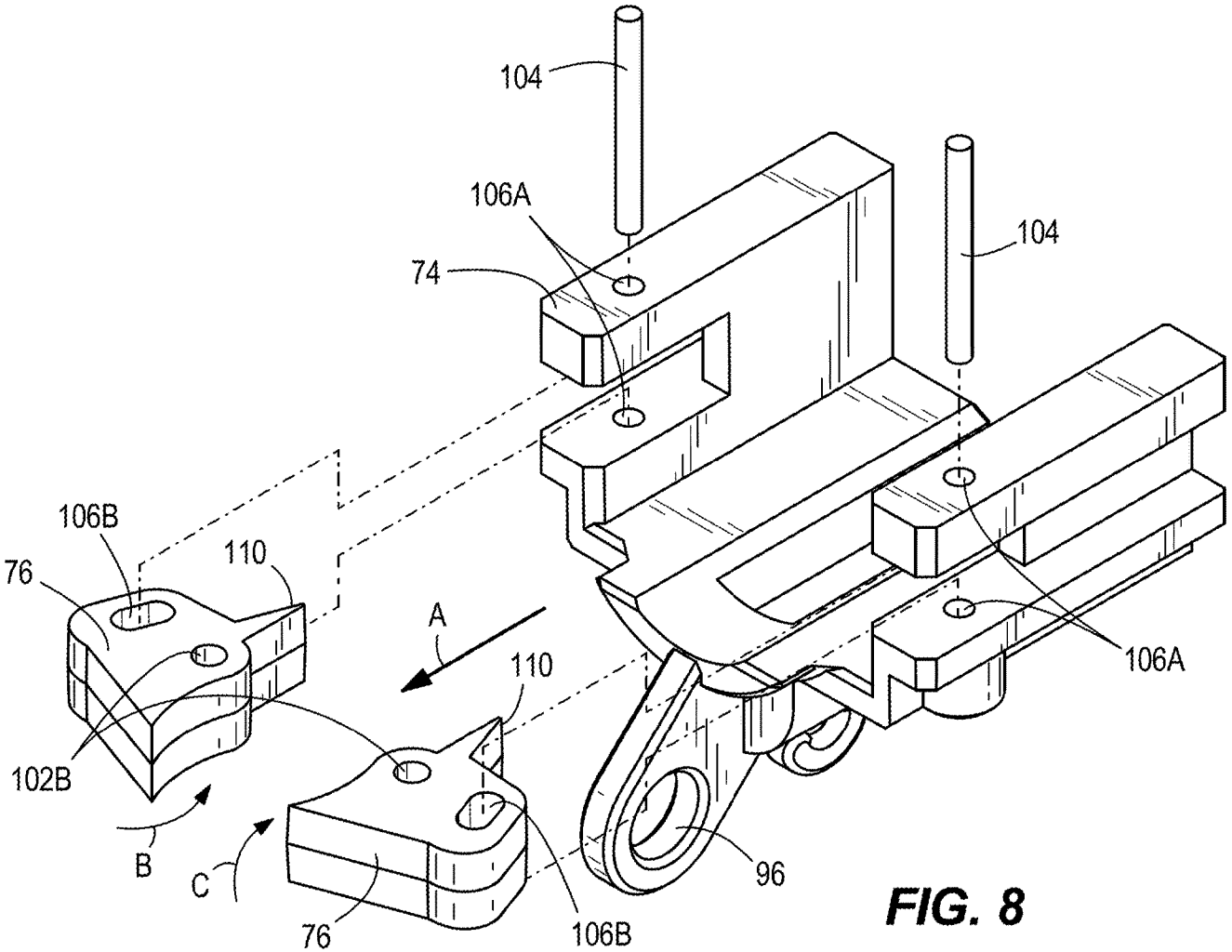
FIG. 8 is a further exploded assembly view of a portion of the feeder assembly.
Figure 9:
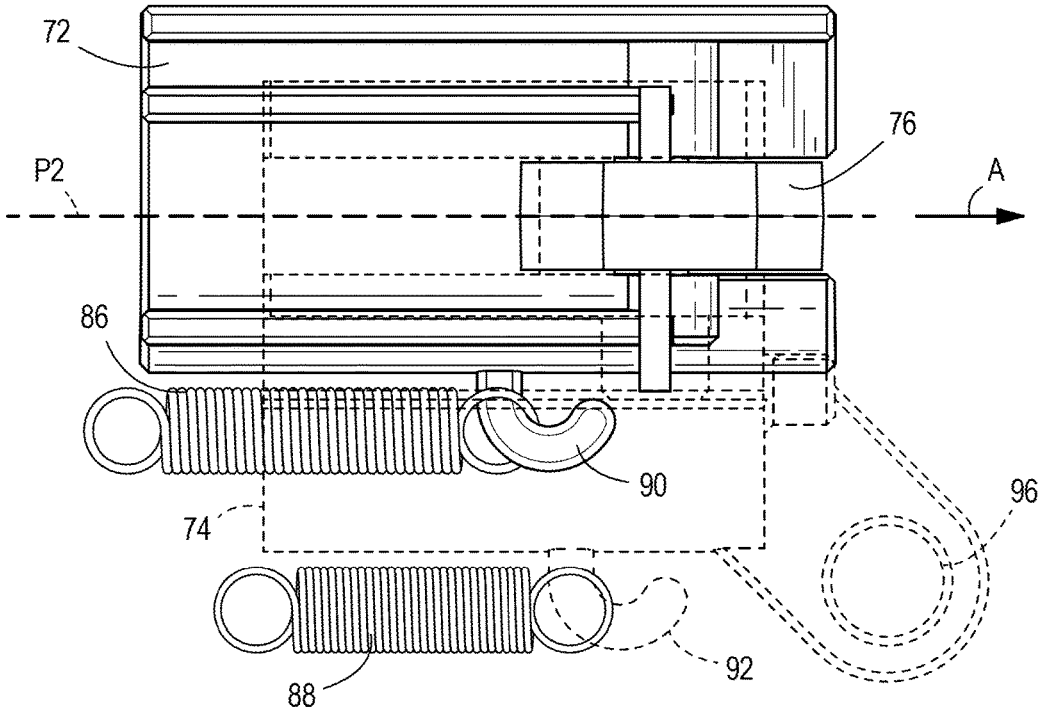
FIG. 9 is a side view of the feeder assembly, with a portion thereof made transparent to illustrate an interior spring connection.
Figure 10:
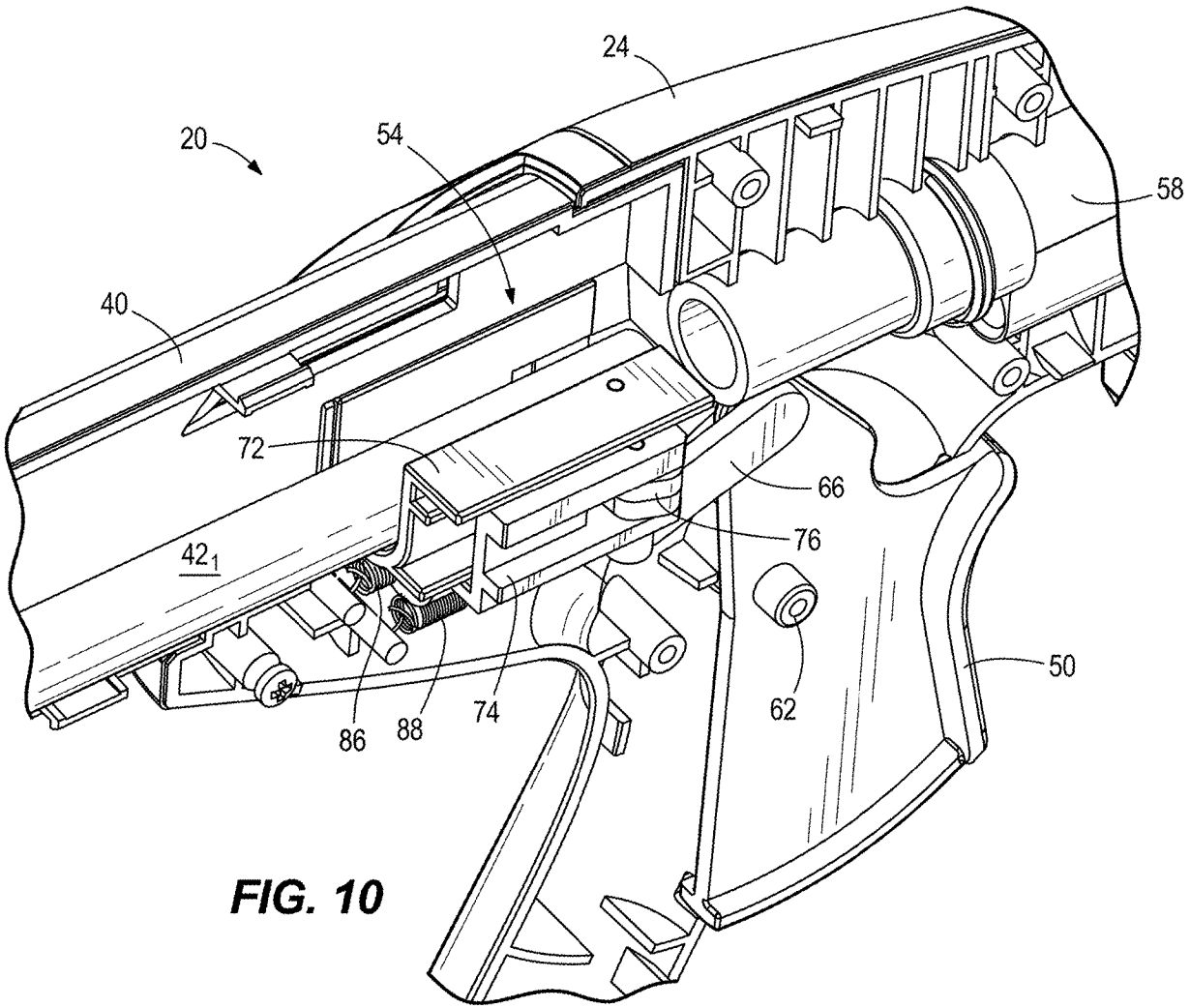
FIGS. 10 to 12 are perspective views in which a housing portion is removed to illustrate the interior of the glue gun as the feeder assembly engages a glue stick therein.
Figure 11:
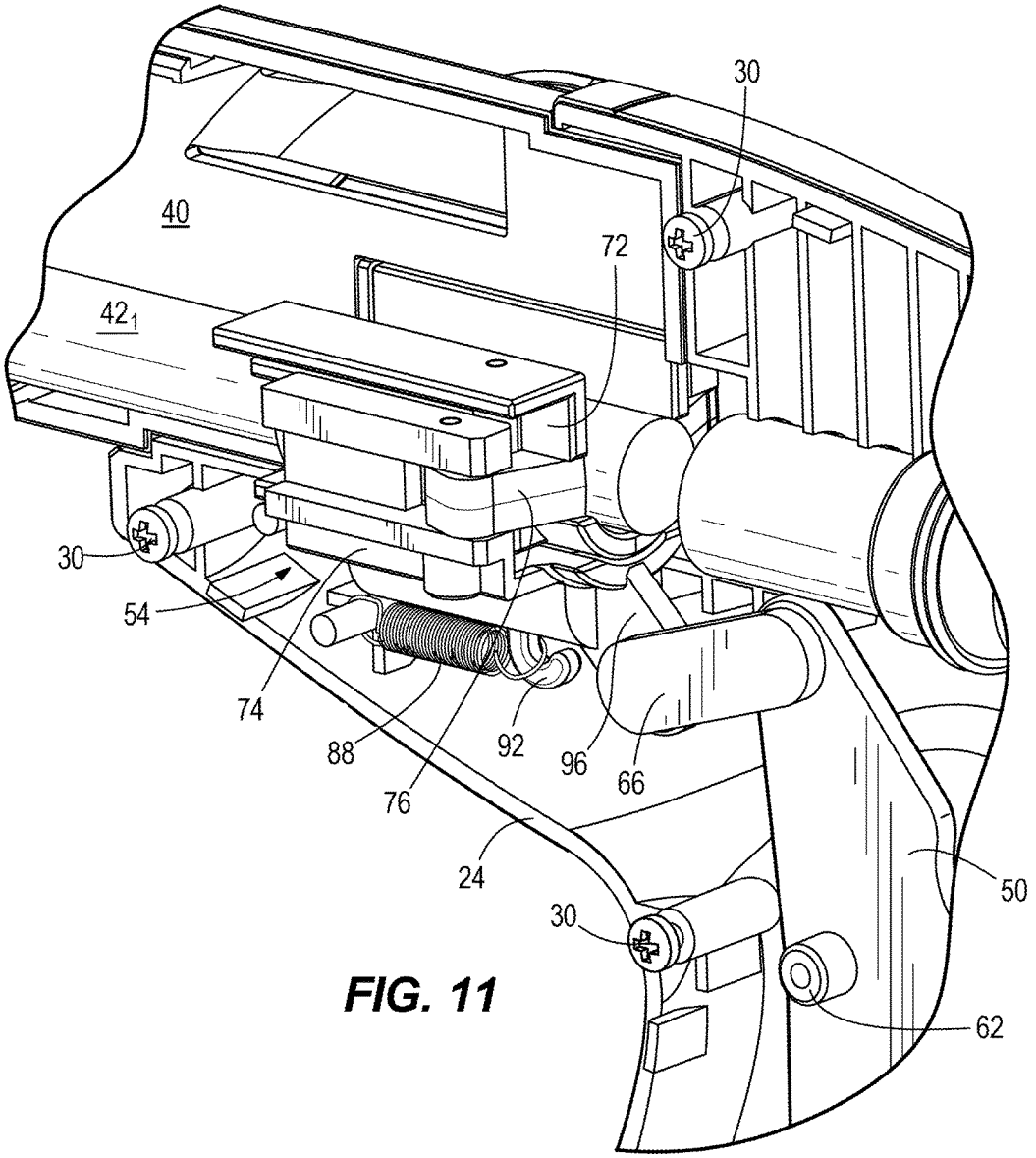
Figure 12:
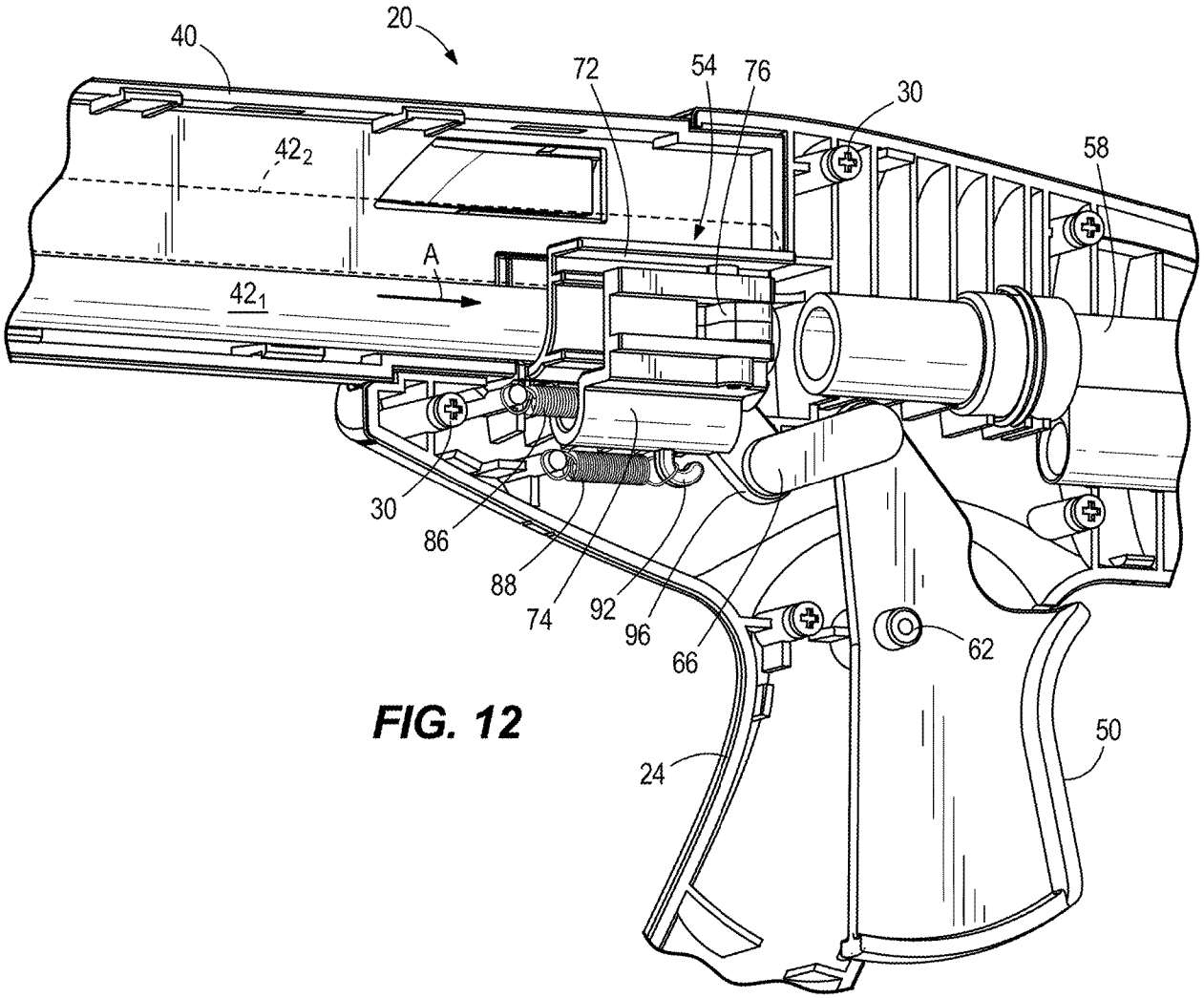

In operation, with both the leading and next-in-line glue sticks $\mathbf{42}_1$, $\mathbf{42}_2$ loaded into the cartridge 40, the leading glue stick $\mathbf{42}_1$ is in the active position, meaning that the stick is within a channel of the feeder tray 72 alongside the base 82 and in position for engagement and feeding by the pincers 76. The cartridge 40 can be open at a forward, bottom portion as shown in FIG. 2, thereby forming a notch 108 or cutaway. Thus, the leading glue stick $\mathbf{42}_1$ or any glue stick in the active position is in position for active engagement with the feeder assembly 54 without exiting or leaving the cartridge 40. Further, a top portion of the cartridge 40 above the notch 108 is positioned, when coupled to the glue gun 20, to extend over (to overlap in plan view) the pincers 76. Prior to actuation of the trigger 50, the feeder assembly 54 is in the condition best illustrated by FIGS. 6 and 11 in which the pincers 76 are retracted from the channel and housed in receptacles alongside the channel formed by the feeder tray 72. As the trigger 50 is pulled or depressed toward the housing 24, it pulls the feeder base 74 forward in the advancing direction A through the coupling link 66. Thus, the feeder base 74 begins to move from the home position against the bias of the spring 88. Because the spring 86 is heavier in resistance than the spring 88, the feeder tray 72 trails the feeder base 74 in advancing motion. The relative movement of the feeder base 74 with respect to the feeder tray 72, which corresponds to an initial presetting travel (e.g., extension) of the spring 88, drives the pincers 76 to deploy. In particular, the pincers 76 deploy so that pointed tips 76A thereof extend into the channel of the feeder tray 72 into interference with the leading glue stick $\mathbf{42}_1$ to press or poke therein. The pointed tips 76A move inwardly toward each other as they deploy. During deployment, the pincers 76 pivot relative to the feeder tray 72 about the pins 100, and this is accommodated by the slotted pin joints at the pins 104. The pincers 76 deploy by pivoting of the pointed tips 76A rearward opposite the advancing direction A, and the deployment rotational directions are indicated by the arrows B, C in FIG. 8. The pincers 76 are positioned directly across the channel from each other to cooperatively pinch the leading glue stick $\mathbf{42}_1$ at a single lengthwise position thereof. Other deployment constructions are optional, and there may be one or more than two pincers 76 in other arrangements from that illustrated. FIG. 7 illustrates the pincers 76 fully deployed, whereby further travel is prevented by bottoming of stops 110 of the pincers 76 against mating surfaces of the feeder base 74. Once the pincers 76 are deployed, the leading glue stick $\mathbf{42}_1$ is physically engaged with the feeder assembly 54 and moves with it in the advancing direction A, as the trigger 50 is further depressed. In this way, the feeder assembly 54 feeds the leading glue stick $\mathbf{42}_1$ into the upstream or rearward portion of the hot end 58. In some examples, the pincers 76 are deployed or "set" within the first 10 percent, the first 20 percent, or the first 30 percent of trigger stroke, with respect to a full available stroke thereof, so that a majority of the trigger stroke is available for pushing the glue stick forward in the advancing direction A.

When the trigger 50 is released by the user, either at or prior to full stroke thereof, the spring 88 first retracts the feeder base 74 by the initial presetting amount relative to the feeder tray 72 so that the pincers 76 are retracted to disengage from the leading glue stick $\mathbf{42}_1$. With the pincers 76 retracted, the entire feeder assembly 54 continues to travel back toward the home position while the leading glue stick $\mathbf{42}_1$ is left in the advanced position. The above mentioned method of feeding the leading glue stick $\mathbf{42}_1$ into the hot end 58 with the feeder assembly 54 does not act on the next-in-line glue stick $\mathbf{42}_2$, which remains at a static position within the cartridge 40. However, once a trailing end of the leading glue stick $\mathbf{42}_1$ advances in the advancing direction A past the position of a leading end of the next-in-line glue stick $\mathbf{42}_2$, the next-in-line glue stick $\mathbf{42}_2$ moves passively (e.g., by gravity alone) into the active position in which the feeder assembly 54, particularly the pincers 76 thereof, can engage it to feed it toward the hot end 58 with each actuation of the trigger 50. As such, there are no required steps or actions, other than pulling and releasing the trigger 50, in order to put the next-in-line glue stick $\mathbf{42}_2$ into the active position upon depletion of the leading glue stick $\mathbf{42}_1$ (i.e., reaching the limit whereby the feeder assembly 54 has fed the trailing end of the leading glue stick $\mathbf{42}_1$ beyond the stroke of the pincers 76). This is of particular advantage over glue guns, even those with multi-stick cartridges, which typically require a user to perform physical manipulation of a glue stick or a loading element of the cartridge to put a next-in-line glue stick into an active state where it becomes trigger-fed for continued use of the glue gun.

Various features and advantages of the invention are set forth in the following claims.

What is claimed is:

1. A glue gun comprising:

a housing including a handle and a barrel, the handle having an upper end mated with the barrel;

an outlet nozzle positioned at a forward end of the housing for dispensing glue;

a multi-stick cartridge configured to hold a plurality of stacked glue sticks, including a leading glue stick held in a channel defining an active position and movable in an advancing direction toward the outlet nozzle, and also a next-in-line glue stick positioned adjacent the active position;

a heating element operable to melt the glue of the leading glue stick prior to being dispensed from the outlet nozzle;

a trigger movably coupled to the housing and operable for advancing the leading glue stick in the advancing direction; and a feeder assembly coupled to the trigger and movable in response to movement of the trigger, wherein the feeder assembly is operable to feed the leading glue stick in the advancing direction so that, upon advancement of the leading glue stick beyond a forward end of the next-in-line glue stick, the next-in-line glue stick drops freely into the active position within the feeder assembly, thus enabling transition from feeding the leading glue stick with the feeder assembly to feeding the next-in-line glue stick with the feeder assembly exclusively by repeated trigger actuation.

2. The glue gun of claim 1, wherein the feeder assembly includes a feeder base, a feeder tray at least partially defining the channel, and at least one pincer deployable from a recessed position to a deployed position, and wherein the at least one pincer extends into the channel in the deployed position.

3. The glue gun of claim 2, wherein the at least one pincer is coupled to the feeder tray with a first pin joint and separately coupled to the feeder base with a second pin joint.

4. The glue gun of claim 2, wherein the at least one pincer is coupled to both the feeder base and the feeder tray in such a way that the at least one pincer is deployed from the recessed position to the deployed position by an advancing movement of the feeder base with respect to the feeder tray.

5. The glue gun of claim 2, wherein the at least one pincer includes two pincers positioned on opposite sides of the channel from one another.

6. The glue gun of claim 2, wherein the at least one pincer is movable between the recessed and deployed positions within a plane that is perpendicular to a plane in which the trigger moves when actuated.

7. The glue gun of claim 2, wherein the feeder tray is coupled to the housing with a first spring, and the feeder base is coupled to the housing with a second spring, and wherein the first spring has a spring constant that exceeds a spring constant of the second spring.

8. The glue gun of claim 7, wherein the spring constant of the first spring exceeds that of the second spring by a factor of at least 1.5.

9. The glue gun of claim 7, wherein the first and second springs extend parallel to each other and parallel to the advancing direction.

10. A glue gun comprising:

a housing including a handle and a barrel, the handle having an upper end mated with the barrel;

an outlet nozzle positioned at a forward end of the housing for dispensing glue;

a multi-stick cartridge configured to hold a plurality of stacked glue sticks, including a leading glue stick held in a channel defining an active position and movable in an advancing direction toward the outlet nozzle, and also a next-in-line glue stick positioned adjacent the active position;

a heating element operable to melt the glue of the leading glue stick prior to being dispensed from the outlet nozzle;

a trigger movably coupled to the housing and operable for advancing the leading glue stick in the advancing direction; and a feeder assembly coupled to the trigger and movable in response to movement of the trigger, wherein the feeder assembly includes:

a feeder tray reciprocable within the housing, the feeder tray having an open top defining an unobstructed path for the next-in-line glue stick to drop freely into the active position, a feeder base reciprocable within the housing and selectively slidable with respect the feeder tray, and at least one pincer coupled to the feeder base and the feeder tray in such a way that the at least one pincer deploys from a recessed position to a deployed position upon actuation of the feeder assembly by the trigger, wherein the at least one pincer extends into the channel in the deployed position.

11. The glue gun of claim 10, wherein the at least one pincer is coupled to the feeder tray with a first pin joint and separately coupled to the feeder base with a second pin joint.

12. The glue gun of claim 10, wherein the at least one pincer is coupled to both the feeder base and the feeder tray in such a way that the at least one pincer is deployed from the recessed position to the deployed position by an advancing movement of the feeder base with respect to the feeder tray.

13. The glue gun of claim 10, wherein the at least one pincer includes two pincers positioned on opposite sides of the channel from one another.

14. The glue gun of claim 10, wherein the at least one pincer is movable between the recessed and deployed positions within a plane that is perpendicular to a plane in which the trigger moves when actuated.

15. The glue gun of claim 10, wherein the feeder tray is coupled to the housing with a first spring, and the feeder base is coupled to the housing with a second spring, and wherein the first spring has a spring constant that exceeds a spring constant of the second spring.

16. The glue gun of claim 15, wherein the spring constant of the first spring exceeds that of the second spring by a factor of at least 1.5.

17. The glue gun of claim 15, wherein the first and second springs extend parallel to each other and parallel to the advancing direction.

18. A method of advancing glue sticks in a glue gun, the method comprising:

providing a plurality of stacked glue sticks, including a leading glue stick held in a channel of a feeder assembly in an active position to be moved by the feeder assembly in an advancing direction toward an outlet of the glue gun, and also a next-in-line glue stick positioned adjacent the active position; and in response to movement of a trigger of the glue gun by a user, the feeder assembly feeding the leading glue stick in the advancing direction, whereby upon advancement of the leading glue stick beyond a forward end of the next-in-line glue stick, the next-in-line glue stick drops freely into the active position within the feeder assembly, and a transition from feeding the leading glue stick with the feeder assembly to feeding the next-in-line glue stick with the feeder assembly occurs exclusively by repeated trigger actuation, without requiring any other steps or actions to put the next-in-line glue stick into the active position upon depletion of the leading glue stick.

19. The method of claim 18, wherein the feeder assembly includes a feeder base, a feeder tray at least partially defining the channel, and at least one pincer deployable from a recessed position to a deployed position in which a pointed end thereof extends into the channel, wherein the feeder base moves in the advancing direction relative to the feeder tray within an initial range of trigger actuation to set the at least one pincer to the deployed position, and wherein, during continued actuation of the trigger beyond the initial range, the feeder tray and the feeder base move together as a unit in the advancing direction.

20. The method of claim 19, wherein the trigger moves within a first plane, and wherein the at least one pincer moves between the recessed and deployed positions within a second plane that is perpendicular to the first plane.

* * * * *